US006343988B1

(12) United States Patent
Walker et al.

(10) Patent No.: US 6,343,988 B1
(45) **Date of Patent: *Feb. 5, 2002**

(54) SYSTEMS AND METHODS WHEREIN A GAMBLING RESULT IS BASED ON A USER INPUT

(75) Inventors: Jay S. Walker, Ridgefield; James A. Jorasch, Stamford, both of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/439,307

(22) Filed: Nov. 12, 1999

Related U.S. Application Data

(63) Continuation of application No. 08/833,034, filed on Apr. 3, 1997, now Pat. No. 6,010,404.

(51) Int. Cl.[7] ..... A63F 9/24

(52) U.S. Cl. ..... 463/21; 463/20; 273/143 R

(58) Field of Search ..... 463/1, 11–13, 463/16, 20, 21, 22, 23, 25, 29, 30, 36, 40, 42; 700/91–93; 273/143 R, 292–293; 382/100, 115–116, 118–124

(56) References Cited

U.S. PATENT DOCUMENTS

| | | | | |
|---|---|---|---|---|
| 3,580,581 A | | 5/1971 | Raven | |
| 4,448,419 A | | 5/1984 | Telnaes | |
| 4,695,053 A | | 9/1987 | Vazquez | |
| 4,856,787 A | * | 8/1989 | Itkis | |
| 4,922,522 A | | 5/1990 | Scanlon | |
| 4,996,705 A | * | 2/1991 | Entenmann | |
| 5,102,134 A | | 4/1992 | Smyth | |
| 5,229,764 A | | 7/1993 | Matchett et al. | |
| 5,269,521 A | | 12/1993 | Rossides | |
| 5,373,440 A | | 12/1994 | Cohen et al. | |
| 5,429,361 A | | 7/1995 | Raven et al. | |
| 5,470,081 A | | 11/1995 | Sato | |
| 5,524,888 A | | 6/1996 | Heidel | |
| 5,768,382 A | | 6/1998 | Schneier et al. | |
| 6,010,404 A | * | 1/2000 | Walker | 463/21 |

OTHER PUBLICATIONS

"Smart Cards Meet Biometrics", Card Technology, Sep./Oct. 1996, pp. 30–38.

"Issuers Finally Give Biometrics A Postive ID", Debit Card News, vol. 1, No. 15, Jan. 29, 1996, pp. 1, 3, 8.

* cited by examiner

*Primary Examiner*—Mark Sager
(74) *Attorney, Agent, or Firm*—Dean P. Alderucci

(57) ABSTRACT

A method and apparatus for using player input codes (e.g., numeric, biometric or physical) to affect the outcomes of electronic gambling devices, such as slot machines. The player inserts money into the slot machine and enters an input, e.g., a lucky number or biometric measurement, into a device attached externally to the slot machine. A central processing unit ("CPU") within the slot machine receives the input and directs a random number generator to produce a random number. The CPU retrieves a combination algorithm from an algorithm database and then applies the combination algorithm to the player number and the generated random number to form a combined value. The CPU looks up the combined value in a probability table to determine resulting reel positions. The CPU looks up the reel positions in a payout table to determine the amount of money won or lost by the player. If the player has won, the CPU directs a hopper controller to release the appropriate number of coins or tokens into a payout tray.

20 Claims, 7 Drawing Sheets

56

| ALGORITHM IDENTIFICATION NUMBER 210 | REQUIRED INPUTS 220 | ALGORITHM 230 |
|---|---|---|
| 1 | PIC, RN, TIME | $(PIC \times RN)^2 \times TIME$ |
| 2 | PIC, RN, K, TIME | $(PIC + RN + K)^2 \times TIME$ |

FIG. 4

72

| PLAYER IDENTIFICATION NUMBER 310 | PREFERRED NUMERIC INPUT CODE 320 | BIOMETRIC DATA 330 | PHYSICAL SENSOR DATA 340 |
|---|---|---|---|
| GF5892 | 12758 | 963248503682 | 382190553272 |
| JK4956 | 43267 | 112984623789 | 913301448306 |

FIG. 5

SYSTEMS AND METHODS WHEREIN A GAMBLING RESULT IS BASED ON A USER INPUT

CROSS REFERENCE TO RELATED APPLICATIONS

The present application is a continuation of U.S. patent application Ser. No. 08/833,034 filed Apr. 3, 1997, now U.S. Pat. No. 6,010,404.

BACKGROUND OF THE INVENTION

1. Field of the Invention

The present invention relates generally to a method and apparatus for operation of a gambling device, such as a slot machine and, more particularly, to the use of a player input code (e.g., numeric, biometric or physical) to affect the outcome of an electronic gambling device.

2. Description of the Related Art

Many gamblers superstitiously believe that when they are feeling "lucky" they are sure to win. In casino games which allow players to add their personal input into the games, the players often believe that their "lucky" feelings are transferred to the objects of their input and that they can therefore somehow "control" the outcome of the game. For example, in the game of craps, many players believe that their good luck is transferred into the throw of the dice. They may therefore blow on the dice before throwing them or even throw them with a certain force or in a certain manner. In blackjack, players often believe that cutting the cards at a certain location in the deck has an influence on whether they will win or lose.

Of course such efforts to "control" the outcome of these games, unless cheating is employed, is purely illusory. However, it is this "illusion of control" that adds to player enjoyment, and in some cases is a primary attraction for these games. Although the "illusion of control" is present in table games such as blackjack and craps, it is conspicuously absent from modern electronic slot machines. In an electronically controlled slot machine, the player simply pushes a starter button and hopes for a winning result. The player does not typically believe that he has any influence over the outcome.

Since the 1970s, such electro-mechanical gambling devices have gained popularity in casinos. These electronic slot machines include reel-bearing slot machines, video poker machines, video blackjack and video keno games. The outcomes of these gambling devices are solely microprocessor controlled. For example, pulling the handle or pushing a button to start an electronic reel-bearing slot machine simply activates a random number generator that generates a number corresponding to a reel position. The resultant reel position determines the amount of payout to the player. Because there is no way for the player to control the outcome of the machine, many players resort to searching for "lucky" machines. In a busy casino, however, there may be a limited number of machines available for selection. In video poker, although players are able to select which cards to hold and which cards to discard, the player has no control over what cards are originally dealt to him. Unlike blackjack, where a player can participate by cutting the cards, no such option exists for video poker players.

The game of Keno offers the player a chance to match a series of player-selected numbers against a series of numbers drawn by the Keno system. The player selects a series of numbers and the system then randomly selects the winning series of numbers. Thus, although players can select their "lucky" numbers, these selections have no impact on the numbers drawn for the game.

The common feature of these electronic gambling devices is that a gambler can only hope that their "lucky" feelings are transferred into an object such as the "SPIN" button of the electronic slot machine. In other words, there is no relationship between the gamblers' physical actions and the final outcome of electronic gambling devices.

Accordingly, there is a need to incorporate a player benefit of the "illusion of control" into modern electronic gaming devices by providing a method and apparatus for utilizing a player input code (e.g., numeric, biometric or physical) which can be combined with a random number to generate the outcome of an electronic gambling device.

SUMMARY OF THE INVENTION

A method and apparatus is provided for using a player input code (e.g., numeric, biometric or physical) to affect the outcome of an electronic gaming device.

The gaming device comprises a means for receiving a user input code, means for receiving a random number, and a means for generating a numeric output as a function of the user input code and the random number.

The present invention also utilizes a server for controlling a plurality of gaming devices. The server comprises means for receiving a player identifier from a gaming device, a memory having a database with a first field representing the player identifier and a second field representing a player input code corresponding to the player identifier, means for accessing the player input code using the player identifier, and means for transmitting the player input from the database to the gaming device.

BRIEF DESCRIPTION OF THE DRAWINGS

FIG. 4 is a schematic view of an algorithm database;

FIG. 5 is a schematic view of a player database; and

DETAILED DESCRIPTION OF PREFERRED EMBODIMENTS

The present invention is directed generally to a method and apparatus for using a player input code (e.g., numeric, biometric, or physical) to affect the outcome, or payout, of an electronic gaming device such as an electronic slot machine.

A method according to one embodiment of the present invention with respect to an electronic slot machine is illustrative. The player inserts money into the slot machine and enters an input, e.g., a number, into a device attached externally to the slot machine. A central processing unit ("CPU") within the slot machine receives the input and directs a random number generator to produce a random number. The CPU retrieves a combination algorithm from an algorithm database and then applies the combination algorithm to the player number and the generated random number to form a combined value. The CPU looks up the combined value in a probability table to determine resulting reel positions. The CPU looks up the reel positions in a payout table to determine the amount of money won or lost by the player. If the player has won, the CPU directs a hopper controller to release the appropriate number of coins or tokens into a payout tray.

In one embodiment of the present invention, a slot network server interfaces with the gaming device and is used to provide the player input code. The player inserts a player tracking card, which contains the player's ID number, into the slot machine. The slot machine then prompts the player to enter his input code into the player input device. The slot machine transmits the data via a slot network to the slot network server, which stores the input code in a player database record corresponding to that player ID number. During each game play, the slot network server communicates the player input code to the slot machine.

Certain preferred embodiments of the present invention will now be described in greater detail with reference to the drawings. Although the embodiments discussed herein are directed to electronic slot machines, it is to be understood that the present invention is equally applicable to other electronic gaming devices, such as video poker machines, video blackjack machines, video roulette machines, video Keno machines, video bingo machines, and the like.

Figure 1:
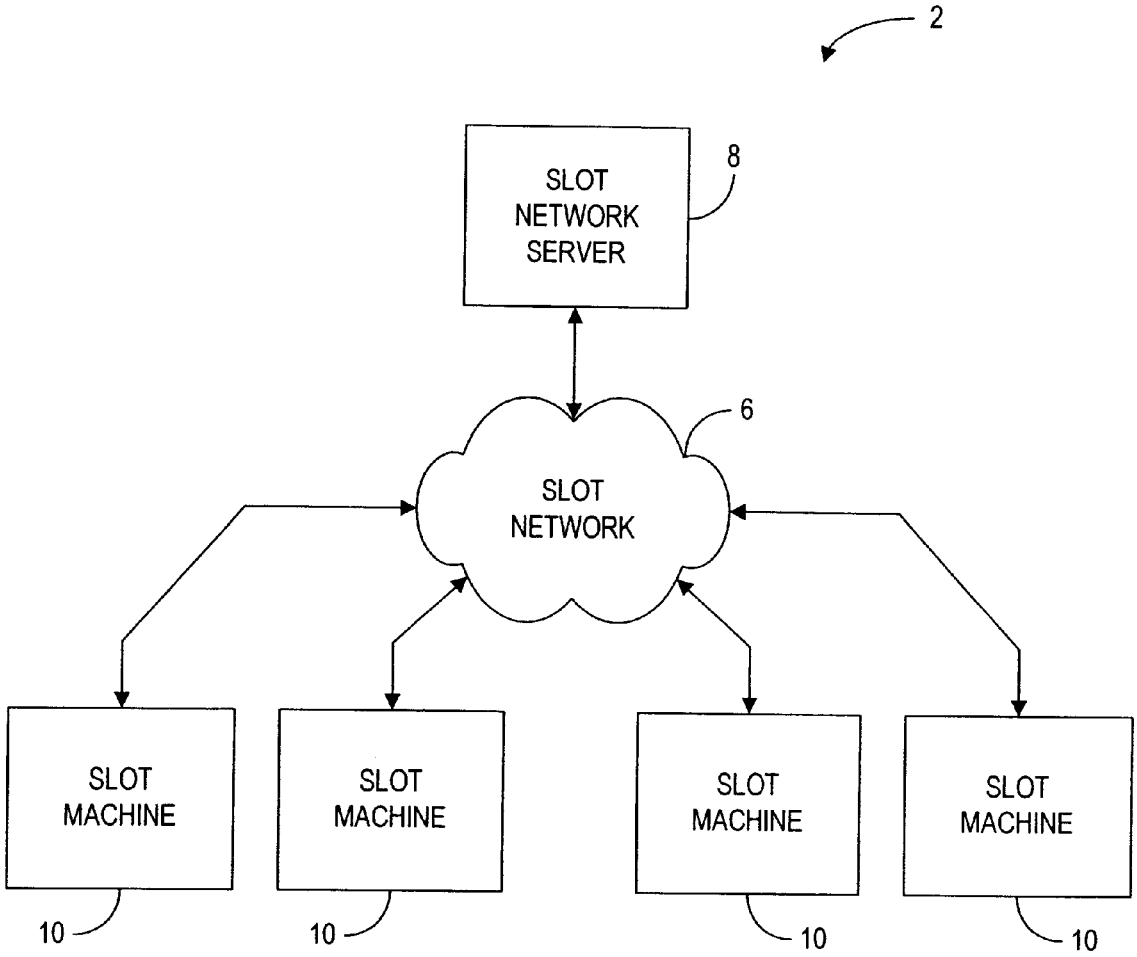
FIG. 1 is a schematic view of a system according to the present invention.

Referring to FIG. 1, a system 2 according to the present invention is shown. In general, the system 2 comprises multiple slot machines 10 and a slot network server 8. Each slot machine 10 is uniquely identified by a machine identification ("ID") number and communicates with the slot network server 8 via a conventional local area network (slot network 6). It is to be understood, however, that other arrangements in which the slot machines 10 communicate with the slot network server 8 are within the scope of the present invention, such as across a wireless network or Internet connection.

As will be described in greater detail below, the slot machines 10 communicate player identifying information and player input codes to the slot network server 8. The slot network server 8 stores the information received from the slot machines 10, and when queried by one of the slot machines 10 as identified by number, communicates the information to the querying slot machine 10. With this arrangement, the player does not have to continuously input a new number or biometric for each play, which can be time-consuming and frustrating. Instead, the player can enter his input, e.g., a string of "lucky" numbers, into one slot machine 10 at one time and automatically use those numbers for game play at that or any another slot machine 10.

Figure 2:
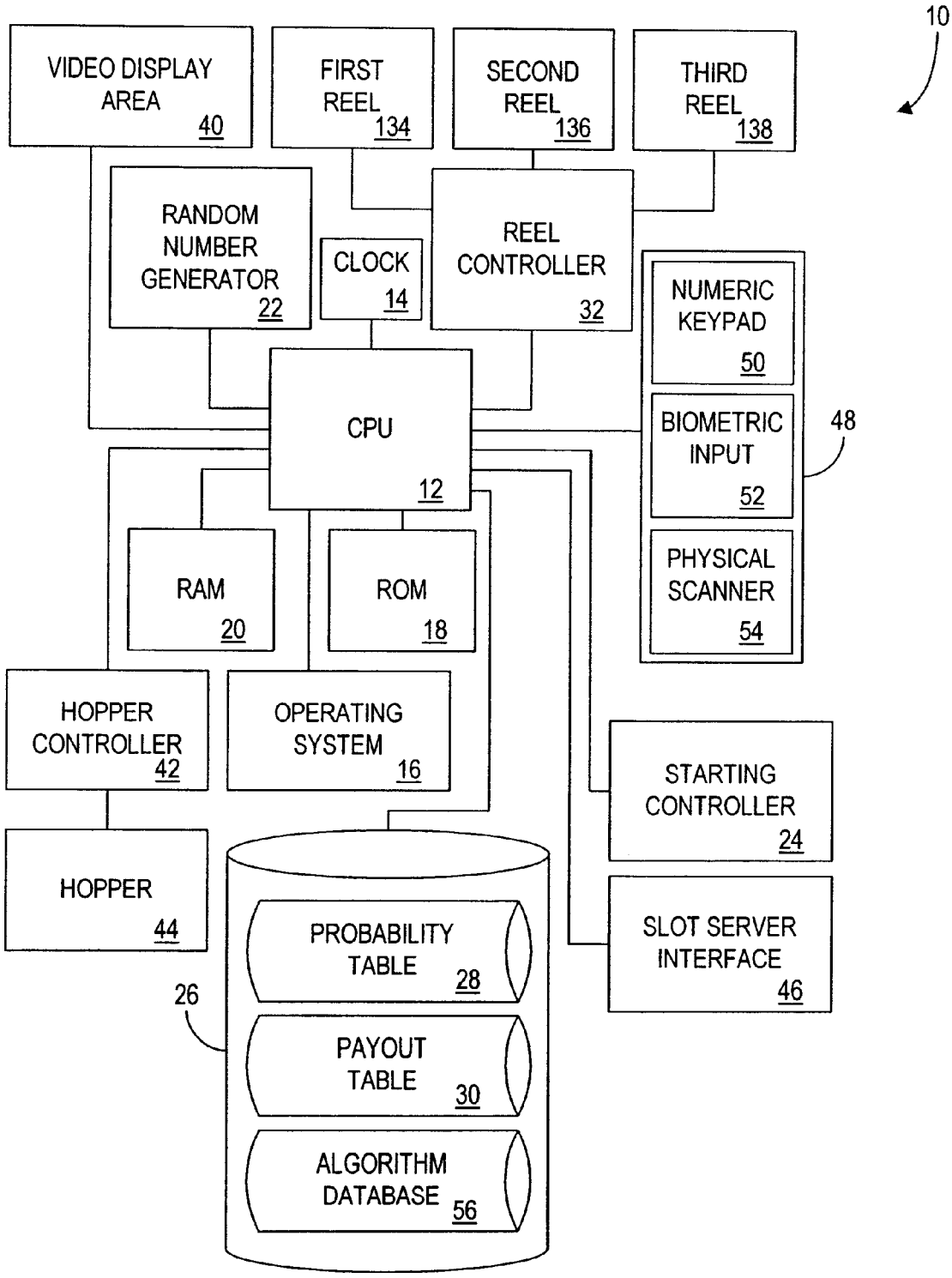
FIG. 2 is a schematic view of the slot machine of FIG. 1.

With reference now to FIG. 2, the slot machine 10 according to the present invention will now be described in greater detail. The slot machine 10 generally includes a CPU 12 that controls the operations of the slot machine 10. The CPU 12 is electronically connected to a clock 14, an operating system 16 (typically stored in memory as software), a Read Only Memory ("ROM") 18, a Random Access Memory ("RAM") 20, a Random Number Generator ("RNG") 22, a starting controller 24, a data storage device 26, a reel controller 32 (connected to reels 34, 36 and 38), a video display area 40, a hopper controller 42, a slot server interface 46, and a player input device 48.

The slot server interface 46 provides the communication path from the slot machine 10 to the slot network server 8, via the slot network 6.

The player input device 48 is shown as a numeric keypad 50, a biometric reader 52 or a physical scanner 54, although the player input device 48 may be any device known in the art operative to receive a player input, or may be any combination of the above.

The numeric keypad 50 allows a player to key in a number as input. Numeric input can alternatively be obtained by, although not limited to, a touch screen, a casino player tracking card, player selection from a set of numbers provided by the slot machine 10, or preferred player numbers stored at either the slot network server 8 or slot machine 10 and used as defaults, as will be discussed in more detail below.

The biometric reader 52 reads a player's personal physical characteristics such as the player's fingerprint, hand geometry, heart rate, body temperature, iris pattern, retinal pattern, voice, signature, or thermal image. During the reading process, software is used to translate the player's physical characteristics into numeric codes, digitizing each biometric feature. The software used for translation may be located either internally within the biometric reader 52 or stored in the ROM 18. In one embodiment of the present invention, the biometric reader 52 is operative to convert each measured characteristic into a numeric input code.

The physical scanner 54 measures physical motions of the player such as the speed and direction of the player's hand waved across the physical scanner 54, the force the player applies in the twisting and turning of knobs, or the pressure the player applies against an object. As with the biometric reader 52, in one embodiment of the present invention the physical scanner 54 is operative to convert each measurement into a numeric input code.

The data storage device 26 is a memory device containing an algorithm database 56, a probability table 28, and a payout table 30.

The algorithm database 56, as shown in FIG. 4, contains records of algorithms that may be used for calculating a combined value, i.e., a value reflecting a combination of a random number selected by the slot machine 10 and a player input number, which will be discussed in detail below. Each record has three fields: field 210 represents an algorithm identification number; field 220 represents the inputs required for calculating the combined value using the algorithm; and field 230 represents the algorithm itself.

There can be any number of algorithms stored in the algorithm database 56 and the slot machine 10 can be programmed to either select an algorithm at random for each game play or for a given number of game plays. Examples of representative algorithms requiring inputs of at least a player input code ("PIC") and a random number generated by the slot machine 10 ("RN"), and optionally the current time, in seconds, as measured by the clock 14 ("TIME"), and/or a constant ("K") are as follows:

Algorithm #1: $[PIC \times RN]^2 \times TIME$

Algorithm #2: $[PIC+RN+K]^2 \times TIME$

With respect to the algorithm with its identification number as "1", i.e., Algorithm #1, for purposes of illustration, field 210 would contain {1}field 220 would contain {PIC, RN, TIME}, and field 230 would contain $\{[PIC \times RN]^2 \times TIME\}$.

The probability table 28 contains multiple records containing information relevant to reel positioning. Each record is comprised of two fields, the first field representing a range of values in which the combined value may fall, and the second field representing the resulting position for each reel 34, 36 and 38. For example, the first field may contain the range of {1 to 10,000), and the second field may contain the resultant reel positions as (Cherry, Cherry, Bar). For example, if the combined value of a game play is 523, reel 34 will spin to a "Cherry," reel 36 will spin to a "Cherry," and reel 38 will spin to a "Bar."

As will be discussed in more detail below, the second field containing resulting reel positions could consist of only a single reel position. For example, for a range of {1 to 10,000}, the resultant reel position is (Cherry}; for a range of {10,001 to 20,000}, the resultant reel position is (Bell); and for a range of {20,001 to 30,000}, the resulting reel position is {Bar}. Thus, each reel position would be have to be determined individually as opposed to by group by independently calculating a combined value for each reel. For example, using the fields described above, in a game play consisting of three independently calculated combined values of {25,243; 567; 11,899}, the resulting positions of reels 34, 36 and 38, respectively, are {Bar, Cherry, Bell}.

The payout table 30 also contains multiple records, with each record containing information relating to the amount of money won or lost by the player for each resultant reel position. Each record consists of two fields, the first field representing the resultant reel positions, and the second field representing the appropriate payout. For example, for a resultant reel position of {Cherry, Cherry, Bell}, the appropriate payout is {5 coins}.

Also in communication with the CPU 12 is a player tracking device (not shown). The player tracking device comprises a conventional card reader for reading player identification information stored on a player tracking card. As used herein, the term "player identifying information" denotes any information or compilation of information that uniquely identifies a player. In the present embodiment, the player identifying information is a player identification ("ID") number. Although not so limited, the player tracking card of the present invention stores the player ID on a magnetic strip located thereon. Commercially available player card tracking devices include, for example, the Mastercom device available from Bally Manufacturing. (See, for example, U.S. Pat. No. 5,429,361 to Raven et al.). The utilization of the player ID number by the system 2 will be discussed in greater detail below.

With the exception of the inclusion of the player input device 48 and the utilization of player input codes to determine resultant reel positions, the slot machine 10 operates in a conventional manner, which will now be described.

During operation of a conventional slot machine, the CPU 12 executes instructions of a program stored in the ROM 18, and passes information to be temporarily stored in the RAM 20. The player starts the slot machine 10 by inserting coins into a coin acceptor on the slot machine 10 or by selecting the use of stored electronic credit. A detector determines the number of coins that were fed into the slot machine 10 and establishes the appropriate electronic credit. The coins pass along a conduit into the hopper 44. The player then selects the amount of electronic credit he wishes to bet, and activates the starting controller 24 by either pressing a "SPIN" button or pulling a handle. Under control of a program stored in, for example, the data storage device 26 or the ROM 18, the CPU 12 initiates the RNG 22 to generate a random number. The CPU 12 refers to the probability table 28 and finds the reel positions that correspond to the generated random number. Based on the identified reel positions, the CPU 12 locates the appropriate payout in the payout table 30. The CPU 12 directs the reel controller 32 to spin (via a motor) the reels 34, 36 and 38 for a short period of time and to then stop them at a point when they display the appropriate symbols. If the player wins, the slot machine 10 stores the credits in the RAM 20 and displays the credits in the video display area 40. When the player requests to cash out by pushing a button on the slot machine 10, the CPU 12 checks the RAM 20 to see if the player has any credit, and if so, signals the hopper controller 42 to release an appropriate number of coins from the hopper 44 into a payout tray (not shown).

In alternative embodiments, the slot machine does not include the reel controller 32 and reels 34, 36 and 38. Instead, the video display area 40 graphically displays representations of objects contained in the selected game, such as graphical reels or playing cards. These representations are preferably animated to display playing of the selected game.

Figure 3:
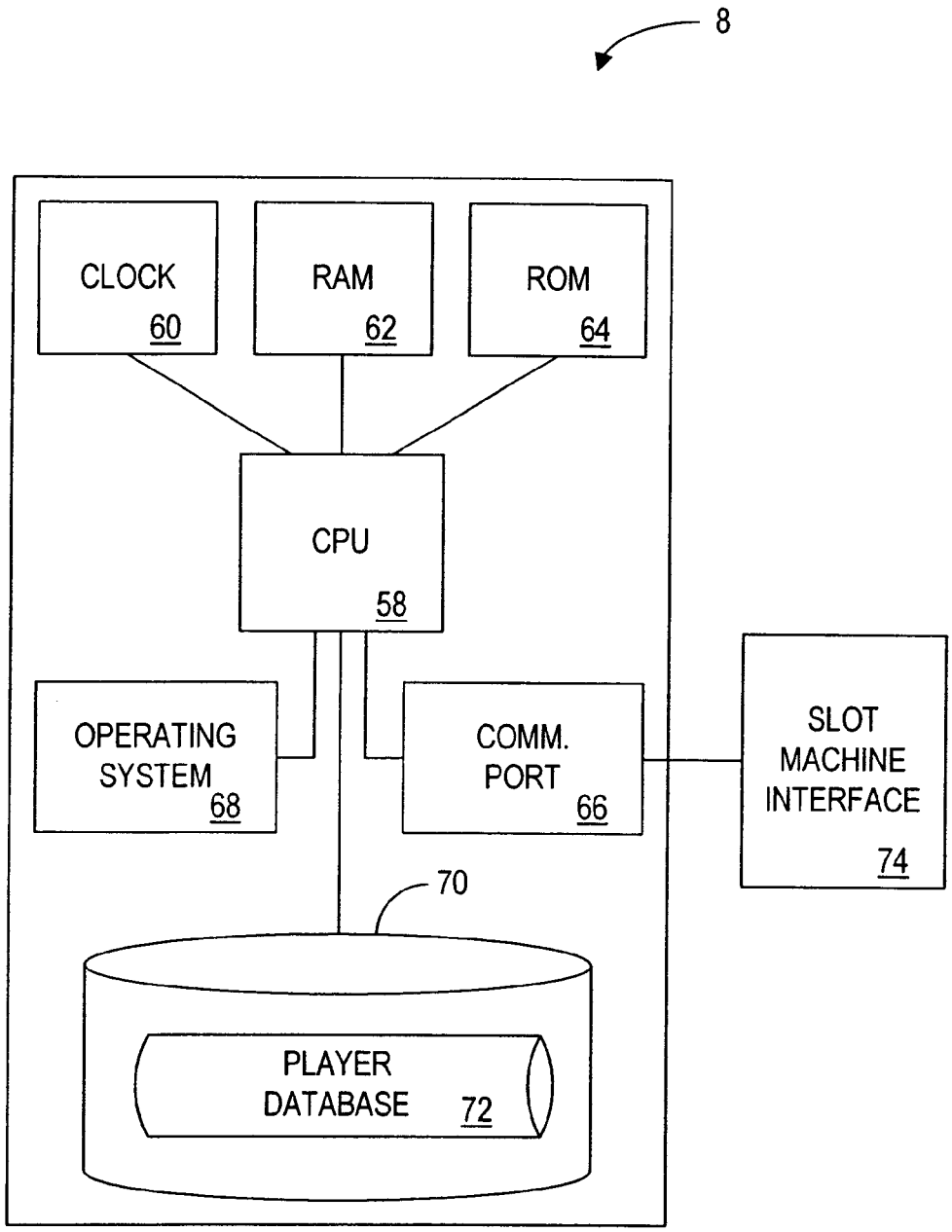
FIG. 3 is a schematic view of the slot network server of FIG. 1.

With reference to FIG. 3, the slot network server 8 will now be described in greater detail. As with the slot machine 10 of FIG. 2, the slot network server 8 is controlled by a CPU 58. The CPU 58 is electronically connected to a clock 60, a RAM 62, a ROM 64, a communications port 66, an operating system 68, and a data storage device 70.

The slot network server 8 also includes a slot machine interface 74 connected to the CPU 58 via the communications port 66. The slot machine interface 74 allows the slot network server 8 to communicate with the slot machines 10 coupled to the slot network 6.

The data storage device 70 contains a player database 72. The player database 72 of the present embodiment contains multiple records and is shown in FIG. 5. Specifically, each record is associated with a particular player, as represented in field 310 by a player identification ("ID") number. The other fields represented in each record include a player's preferred input numbers (field 320), a player's biometric input (field 330), and a player's physical sensor data (field 340). Thus, by obtaining a player's ID number, the slot network server 8 can retrieve all other information pertaining to that player stored in fields 320, 330 and 340.

It is to be understood that not all of these identifying fields are necessary for operation of the present embodiment. Furthermore, other fields may be included to provide additional player identification information, such as the player's name, social security number, address, telephone number, credit card number, or hotel room number.

Figure 6A:
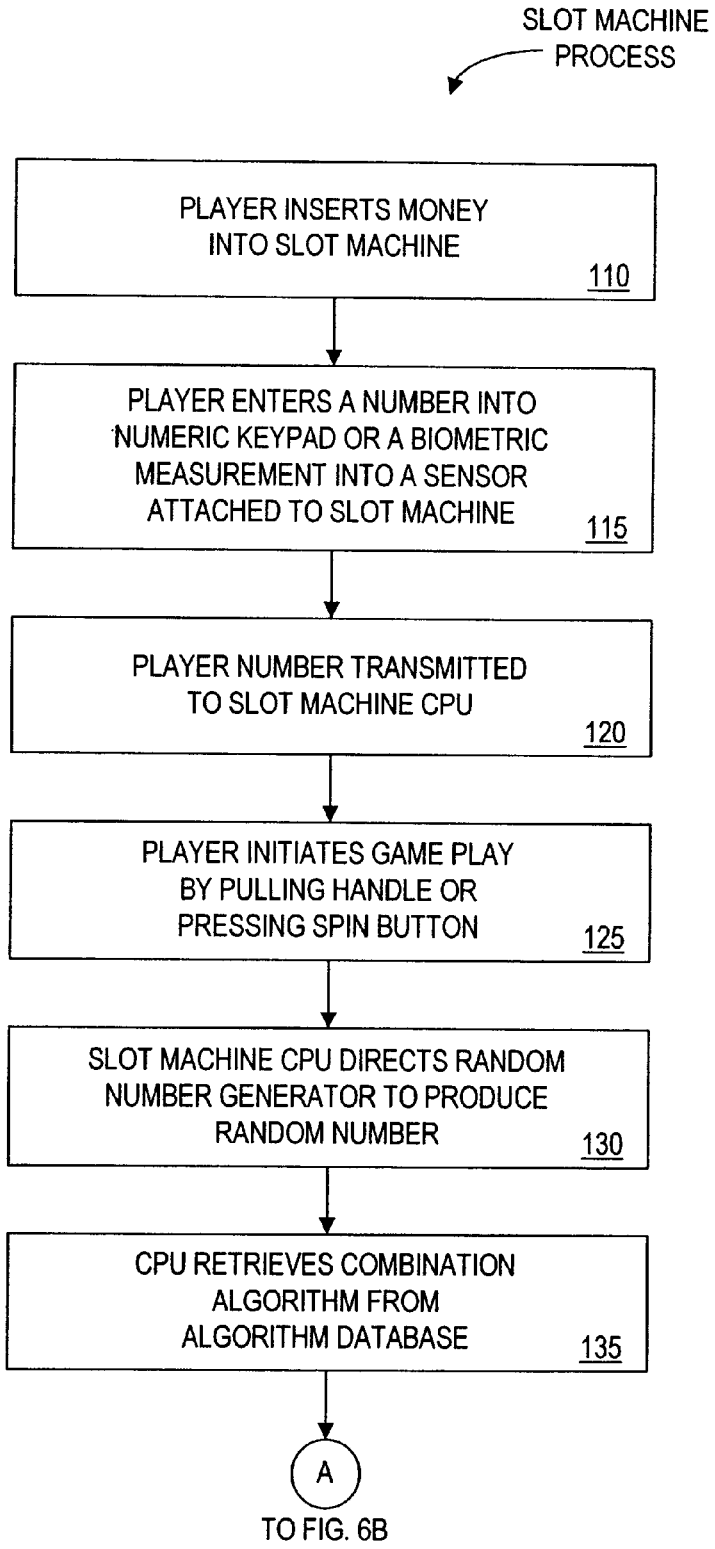
FIGS. 6A and 6B are flow diagrams depicting the process of playing the slot machine without the slot network server.
Figure 6B:
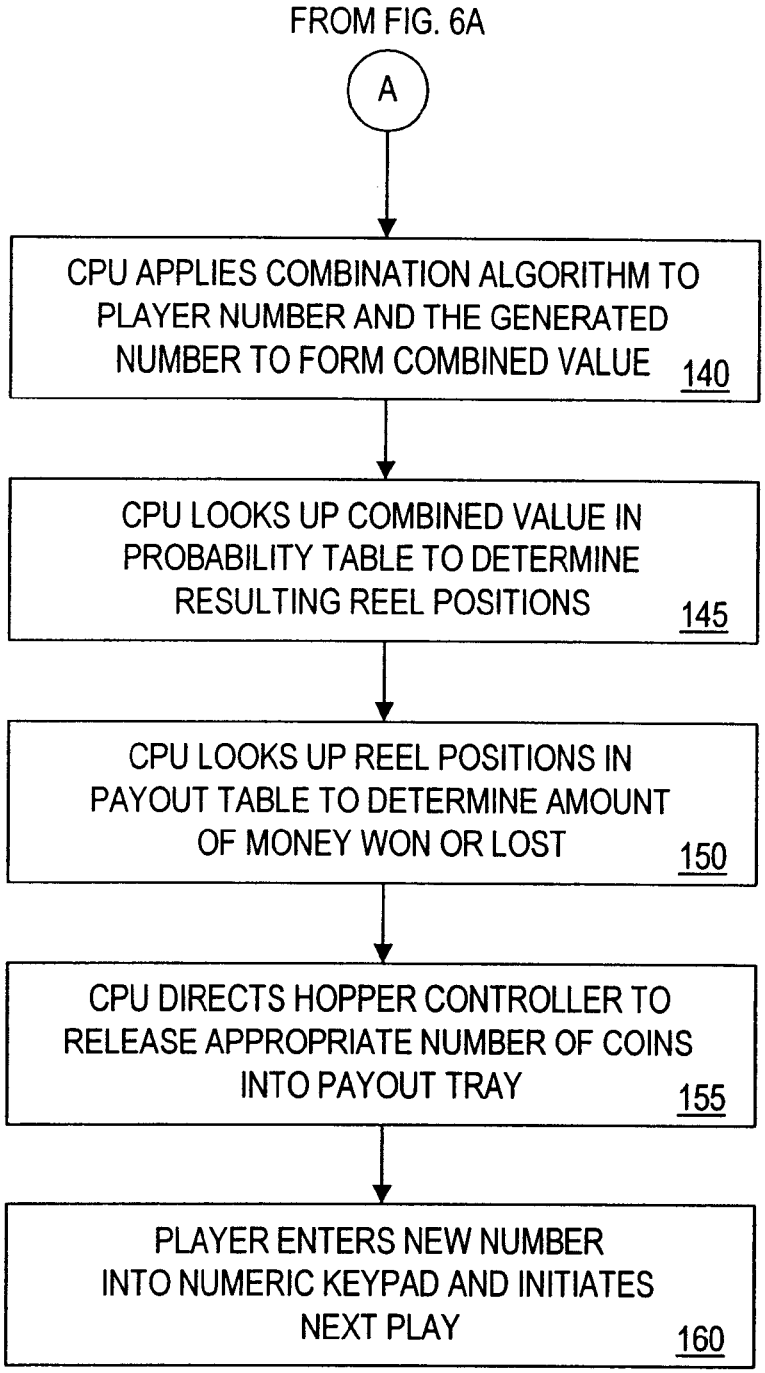

Having thus described the components of the present embodiment, the operation of the slot machine 10 (without the slot network server 8) will now be described with reference to FIGS. 6A and 6B.

As shown in step 110, the player starts the operation of the slot machine 10 by inserting money into the slot machine 10. After the player selects the amount of credit he wishes to bet, the CPU 12 directs the player input device 48 to prompt the player to enter an input.

In step 115, the player enters his input into the player input device 48. Depending on which type of player input device 48 is utilized at the particular slot machine 10, the input may be either numeric, biometric or physical. For numeric input, the player enters a number into the numeric keypad 50 of the slot machine 10. For biometric input, the player input device 48 is the biometric reader 52 which reads one or a combination of the player's fingerprint, hand geometry, heart rate, body temperature, iris pattern, retinal pattern, voice, signature, or thermal image. For a physical input, the player input device 48 is the physical scanner 54. In the present embodiment, if a biometric or physical input is taken, the device 48 will convert the biometric or physical input into a numeric input code.

In step 120, the player input code is transmitted to the CPU 12 of the slot machine 10. The CPU 12 stores the player input code into the RAM 20, and enables the starting controller 24.

In step 125, the player initiates game play by pulling the handle or pressing the "SPIN" button of the slot machine 10, thereby activating the starting controller 24. The starting controller 24 sends a signal to the CPU 12 that play has been initiated.

In step 130, the CPU 12 of the slot machine 10 directs the RNG 22 to produce a random number within a predetermined range. The random number is stored in the RAM 20.

In step 135, the CPU 12 retrieves a combination algorithm from the algorithm database 56. In the present embodiment, there is only one algorithm in the database which is always selected by the CPU 12 for every game play and requires only the player input code and the slot machine generated random number. In step 140, the CPU 12 applies the combination algorithm to the player input code and the generated random number to form a combined value. The CPU 12 locates the combined value in the probability table 28 to determine the resulting positions of reels 34, 36 and 38 (step 145). The CPU 12 directs the reel controller 32 to adjust the reels 34, 36 and 38 to their appropriate positions.

In step 150, the CPU 12 looks up the reel positions in the payout table 30 to determine the amount of money won or lost by the player. If the player has won, the CPU 12 directs the hopper controller 42 to release an appropriate number of coins from the hopper 44 into the payout tray (step 155).

In step 160, the player enters a new number into the numeric keypad 50 and initiates the next play of the slot machine 10.

In another embodiment of the present invention, the slot network server 8 is used to provide the player input code. The player inserts his player tracking card, which contains the player's ID number, into the slot machine 10. The slot machine 10 then prompts the player to provide his input code into the player input device 48. The slot machine 10 transmits the data via the slot network 6 to the slot network server 8, which looks up the player ID number in field 330 of the player database 72 and stores the player input code in the appropriate field. During each game play, the slot network server 8 communicates the player input code to the slot machine 10. There may be multiple player input codes stored in the player database 72, e.g., a string of the player's "lucky" numbers, in which case the slot network server 8 may be programmed to cycle through the inputs for each game play.

If the player moves to a different slot machine 10, the player can still access his input codes by inserting his tracking card into the slot machine 10, which then transmits the player's ID number to the slot network server 8. The slot network server 8 can then communicate the input codes back to the slot machine 10.

In another embodiment of the present invention, the CPU 12 directs the RNG 22 to generate three different random numbers. Each random number generated is used as input to be used independently in a combination algorithm to determine the individual position of each reel 34, 36 and 38. In this embodiment, the probability table 28 is of the type described above wherein the second field representing the resultant reel position is a single symbol.

In another embodiment of the present invention, an algorithm is selected from the algorithm database 56 by the CPU 12 directing the RNG 22 to select a random number from 1 to N, N being the total number of algorithms in the algorithm database 56. The number selected is the algorithm identification number of field 210. The CPU 12 retrieves the corresponding algorithm in field 230, and reads the inputs that are required other than the player input code or the generated random number in field 220. The CPU 12 obtains the requisite inputs, such as by reading the current time measured by the clock in seconds, and then applies the algorithm to obtain the combined value.

In the case of the embodiment wherein each reel position is determined independently, the CPU 12 can be programmed to either use one algorithm for determining each reel position or select the random number from 1 to N to select a different algorithm for each reel 34, 36 and 38.

In another embodiment of the present invention, the CPU 12 executes a program stored in either the ROM 18 or the data storage device 26 to convert the biometric or physical input into a numeric input code.

In another embodiment of the present invention, the player input device 48 is not limited to a single input, i.e., multiple inputs can be used to determine the output of one game play. For example, a numeric input can be used determine the output of the first reel, a biometric characteristic can be used to determine the output of the second reel, and a physical scanner can be used to determine the output of the third reel. Or, alternatively, two biometric characteristics can be combined to form one single input code.

Although the present invention has been described in terms of certain preferred embodiments, other embodiments that are apparent to those of ordinary skill in the art are also intended to be within the scope of the present invention. Accordingly, the scope of the present invention is intended to be limited only by the claims appended hereto.

What is claimed is:

1. A method for generating a game result of a gaming device, comprising:

receiving information associated with a user input;

calculating a numeric output as a function of the information associated with the user input and a random number, the random number being independent of the user input; and generating the game result based on the numeric output, wherein a user receives a payout based on the game result.

2. The method of claim 1, wherein the user input comprises a biometric user input.

3. The method of claim 2, wherein the biometric user input comprises at least one of: (i) a fingerprint, (ii) a hand geometry, (iii) a heart rate, (iv) a body temperature, (v) an iris pattern, (vi) a retinal pattern, (vii) a voice, (viii) a signature, and (ix) a thermal image.

4. The method of claim 1, wherein the user input comprises a physical user input.

5. The method of claim 4, wherein the physical user input comprises at least one of: (i) a movement of the user, (ii) a speed of the user's hand, (iii) a direction of the user's hand, (iv) a force applied by the user, and (v) a pressure applied by the user.

6. The method of claim 1, wherein the user input comprises a numeric user input.

7. The method of claim 6, wherein the numeric user input comprises a number entered by the user.

8. The method of claim 6, wherein the user provides the numeric user input via at least one of: (i) a touch screen, (ii) a casino player tracking card, (iii) a user selection from a set of numbers, and (iv) stored preferred user numbers.

9. The method of claim 1, wherein the gaming device comprises a slot machine and the game result is displayed via a plurality of at least one of: (i) mechanical reels, and (ii) graphical representations of reels.

10. The method of claim 1, wherein the gaming device comprises at least one of: (i) a video poker machine, (ii) a video blackjack machine, (iii) a video roulette machine, (iv) a video Keno machine, and (v) a video bingo machine.

11. The method of claim 1, further comprising:

generating a plurality of game results based on the information associated with the user input and a plurality of random numbers, each of the plurality of random numbers being independent of the user input, wherein the user receives a plurality of payouts based on the plurality of game results.

12. An apparatus, comprising:

a processor; and a storage device in communication with said processor and storing instructions adapted to be executed by said processor to:

receive information associated with a user input;

calculate a numeric output as a function of the information associated with the user input and a random number, the random number being independent of the user input; and generate a game result based on the numeric output, wherein a user receives a payout based on the game result.

13. A medium storing instructions adapted to be executed by a processor to perform a method of generating a game result of a gaming device, said method comprising:

receiving information associated with a user input;

calculating a numeric output as a function of the information associated with the user input and a random number, the random number being independent of the user input; and generating the game result based on the numeric output, wherein a user receives a payout based on the game result.

14. A computer-readable medium that stores data accessible by a program executable on a data processing system, the data being organized according to a data structure that includes:

a user identifier data object representing a user; and a user input data object, accessible from said user identifier data object, representing information associated with a user input, wherein a numeric output is calculated as a function of the information associated with the user input and a random number, the random number being independent of the user input, a game result is based on the numeric output, and wherein a user receives a payout based on the game result.

15. A method for generating a game result, comprising:

receiving from a server device information associated with a user input;

calculating at a gaming device a numeric output as a function of the information associated with the user input and a random number, the random number being independent of the user input; and generating the game result based on the numeric output, wherein a user receives a payout based on the game result.

16. A method for generating a game result, comprising:

receiving from a first gaming device information associated with a user input;

storing the information associated with the user input;

receiving from a second gaming device a request;

retrieving the information associated with the user input; and providing to the second gaming device the information associated with the user input, wherein a user receives a payout based on the game result, the game result is based on a numeric output, and the numeric output is calculated as a function of the information associated with the user input and a random number, the random number being independent of the user input.

17. A method for generating a game result, comprising:

receiving at a first device information associated with a user input;

receiving an indication of a game play at a second device;

calculating a numeric output as a function of the information associated with the user input and a random number, the random number being independent of the user input; and generating the game result based on the numeric output, wherein a user receives a payout based on the game result.

18. A system, comprising:

a server device configured to provide information associated with a user input; and a plurality of gaming devices coupled to said server device, each of said plurality of gaming devices being configured to receive the information associated with the user input from the server device, calculate a numeric output as a function of the information associated with the user input and a random number, the random number being independent of the user input, and generate a game result based on the numeric output, wherein a user receives a payout based on the game result.

19. A method for generating a game result of a slot machine having a plurality of reels, comprising:

receiving information associated with a numeric user input;

calculating a numeric output as a function of the information associated with the numeric user input and a random number, the random number being independent of the user input;

generating the game result based on the numeric output;

displaying the game result using the plurality of reels; and providing a payout to a user based on the game result.

20. A slot machine, comprising:

an input device configured to receive information associated with a numeric user input;

a reel display; and a game result unit coupled to said input device and said reel display, said game result unit being configured to (i) receive from the input device the information associated with the numeric user input; (ii) calculate a numeric output as a function of the information associated with the numeric user input and a random number, the random number being independent of the user input, (iii) generate a game result based on the numeric output, and (iv) display the game result using the reel display.

* * * * *